United States Patent [19]

Krynski

[11] Patent Number: 4,995,495

[45] Date of Patent: Feb. 26, 1991

[54] CRUDE OIL EMULSION TREATING APPARATUS

[75] Inventor: Stephen V. Krynski, Calgary, Canada

[73] Assignee: HTI Technology Canada Ltd., Calgary, Canada

[21] Appl. No.: 494,442

[22] Filed: Mar. 16, 1990

[30] Foreign Application Priority Data

Apr. 7, 1989 [CA] Canada ..... 596112

[51] Int. Cl.[5] ..... C10G 33/00; B01D 19/00

[52] U.S. Cl. ..... 196/46; 55/174; 55/175; 55/195; 196/46.1; 196/114

[58] Field of Search ..... 196/46, 114, 46.1; 55/174, 175, 195; 208/187

[56] References Cited

U.S. PATENT DOCUMENTS

| | | | |
|---|---|---|---|
| 2,658,025 | 11/1953 | Williams | 196/46 |
| 2,933,447 | 4/1960 | Walker et al. | 196/46 |
| 3,193,990 | 7/1965 | Smith | 55/175 |
| 3,396,512 | 8/1968 | McMinn et al. | 55/175 |
| 3,453,205 | 7/1969 | Francis et al. | 196/46 |
| 4,012,207 | 3/1977 | Jones | 55/174 |
| 4,666,587 | 5/1987 | Martin | 196/46 |

*Primary Examiner*—Joye L. Woodard
*Attorney, Agent, or Firm*—George A. Seaby

[57] ABSTRACT

In attempting to upgrade crude oil to pipeline quality, it often proves necessary to treat the oil in more than one apparatus. A simple solution to the problem is to provide an apparatus including a flashing section coupled to a treating section in which the crude oil is desanded and dewatered. The flashing section heats the oil to a temperature in which water can exist only as a vapor, and the vapor thus generated is discharged through a demister.

5 Claims, 7 Drawing Sheets

CRUDE OIL EMULSION TREATING APPARATUS

BACKGROUND OF THE INVENTION

1. Field of the Invention

This invention relates to an apparatus for treating crude oil, and in particular to an apparatus for separating sand and water from crude oil.

2. Discussion of the Prior Art

In general, it is necessary to treat crude oil to separate various substances such as sand and water from the oil before placing the oil in a pipeline, i.e. it is necessary to upgrade the crude oil to pipeline quality. Apparatuses for treating crude oil of generally the type described herein are disclosed by U.S. Pat. No. 3,389,536 and Canadian Pat. No. 1,152,019, both of which issued to H.R. Bull on June 25, 1968 and Aug. 16, 1983, respectively. While the Bull devices are effective in removing some substances from crude oil, it has been found that the treated crude oil obtained from existing apparatuses may still contain an undesirably high level of water.

GENERAL DESCRIPTION OF THE INVENTION

The object of the present invention is to overcome the above-identified problem by providing a relatively simple apparatus for treating crude oil which upgrades the oil to an acceptable water and sand content.

Accordingly, the present invention relates to an apparatus for treating crude oil comprising casing means; first partition means separating the interior of said casing means into a treating section and a flashing section; inlet pipe means in said casing means for introducing crude oil into the treating section of said casing means; first heater means in said treating section for reducing the viscosity of the crude oil; first baffle means in said treating section for facilitating the separation of water and gas from the oil; gas outlet means in said casing means for discharging gas from said treating section; desand means in said casing means for discharging sand from said treating section; water outlet means in said casing means for discharging water from said treating section; first trough means proximate said first partition means in said treating section for receiving at least partially desanded and dewatered crude oil, oil outlet means for feeding oil from said trough means to said flashing section; second baffle means in said flashing section for distributing oil in said flashing section; second heater means in said flashing section for vaporizing water remaining in said oil; vapor outlet means in said casing means for discharging water vapor from said flashing section; and oil outlet means in said casing means for discharging treated oil from said flashing section.

BRIEF DESCRIPTION OF THE DRAWINGS

The invention will be described in greater detail with reference to the accompanying drawings which illustrate a preferred embodiment of the invention, and wherein.

DESCRIPTION OF PREFERRED EMBODIMENT

Figure 1:
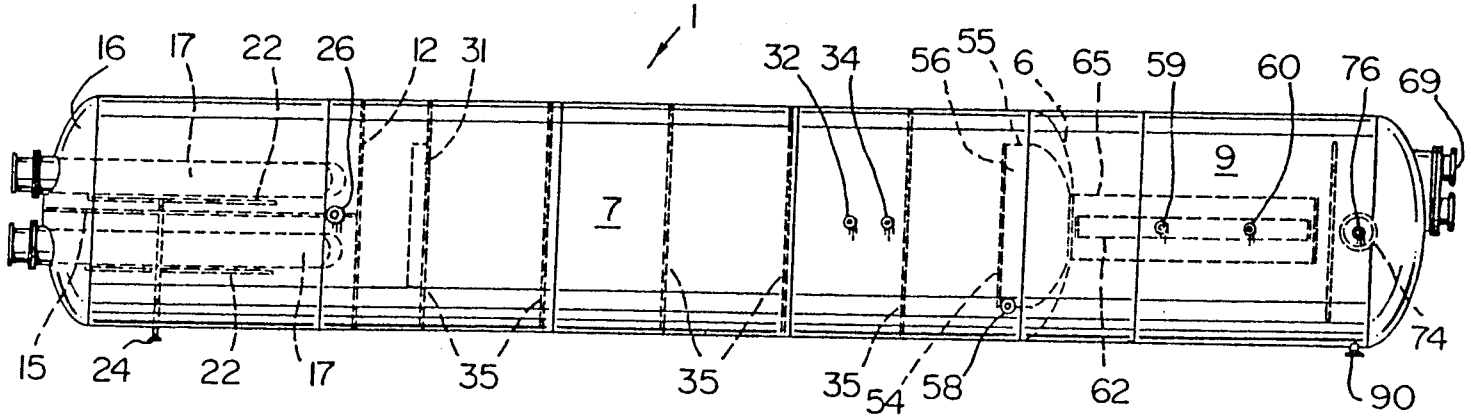
FIG. 1 is a schematic plan view of a crude oil treating apparatus in accordance with the present invention.

With reference to the drawings, the apparatus of the present invention includes an elongated cylindrical casing generally indicated at 1, which is provided with feet 2 at each end thereof for supporting the casing on a skid (not shown). A plurality of so-called manways or ports 3 are provided at various locations in the casing 1 for gaining access to the interior of the casing. A drain 5 is also provided in the casing 1. The casing 1 is divided by a hemispherical internal partition 6 into a treating section 7 and a flashing section 9. Because tanks defining the treating section 7 have already been produced by applicant, the simplest course of action is to add flashing sections 9 to such tanks. However, it will be appreciated that the entire apparatus can be constructed from scratch.

The treating section 7 is divided by a transversely extending, generally circular partition 12 into an inlet chamber 13 and a settling chamber 14. Another partition 15 extends longitudinally from the partition 12 to the end wall 16 of the casing 1 for subdividing the inlet chamber 13 into a pair of heating chambers. Each heating chamber contains a heater defined by a firetube 17 extending into the chamber through the end wall 16 of the casing. The use of two separate heaters in the heating chambers allows for greater control of the temperature of the inlet chamber contents. Each firetube 17 is generally U-shaped, a burner (not shown) being provided on the outer end of the bottom arm, and a flue (not shown) being provided on the outer end of the top arm thereof. A pair of longitudinally extending pipes 22 are provided adjacent to the heaters 17 for preventing the deposition of sand on the heaters. Water is fed into the pipes 22 via inlet pipes 24 and 25 (FIG. 5), and is jetted out of the pipes 22 through small orifices (not shown) against the heaters.

Crude oil containing water and sand is fed through a generally J-shaped inlet duct 26 into the inlet chamber 13, where the crude oils is heated to reduce the viscosity thereof. The oil passes generally in the direction of arrows A through one heating chamber and an opening 27 (FIG. 4) in the front bottom end of the partition 15 into the second heating chamber. Water separating from the oil passes through an opening 28 at the bottom of one side of the partition 12. Oil passes through a slot 29 in such one side of the partition and gas separating from the crude oil passes through an opening 30 between the top of the partition 12 and the top of the casing 1 on such one side of the partition 12. The gas passes through a wire mesh foam breaker 31 and is discharged through an outlet pipe 32 near the downstream end of the treating section 7. Pressure in the treating section 7 of the casing 1 is prevented from rising above a predetermined maximum by a pressure relief valve (not shown) connected to the settling chamber 14 by a pipe 34.

A plurality of crossbars 35 are provided in the settling chamber 14 for supporting louvered baffles 36. The baffles 36 diffuse the oil flow in the chamber 14 and cause coalescing of water droplets. The baffles 36 cause a slight pressure drop, so that the oil is spread across the full diameter of the chamber 14. The edges of the louvers in the baffles 36 cut the oil film around the water droplets to allow the droplets to contact the baffles. The water settles to the bottom of the casing 1 to create a water layer 38 of water beneath an oil layer 39, with an interface 40 therebetween.

Figure 4:
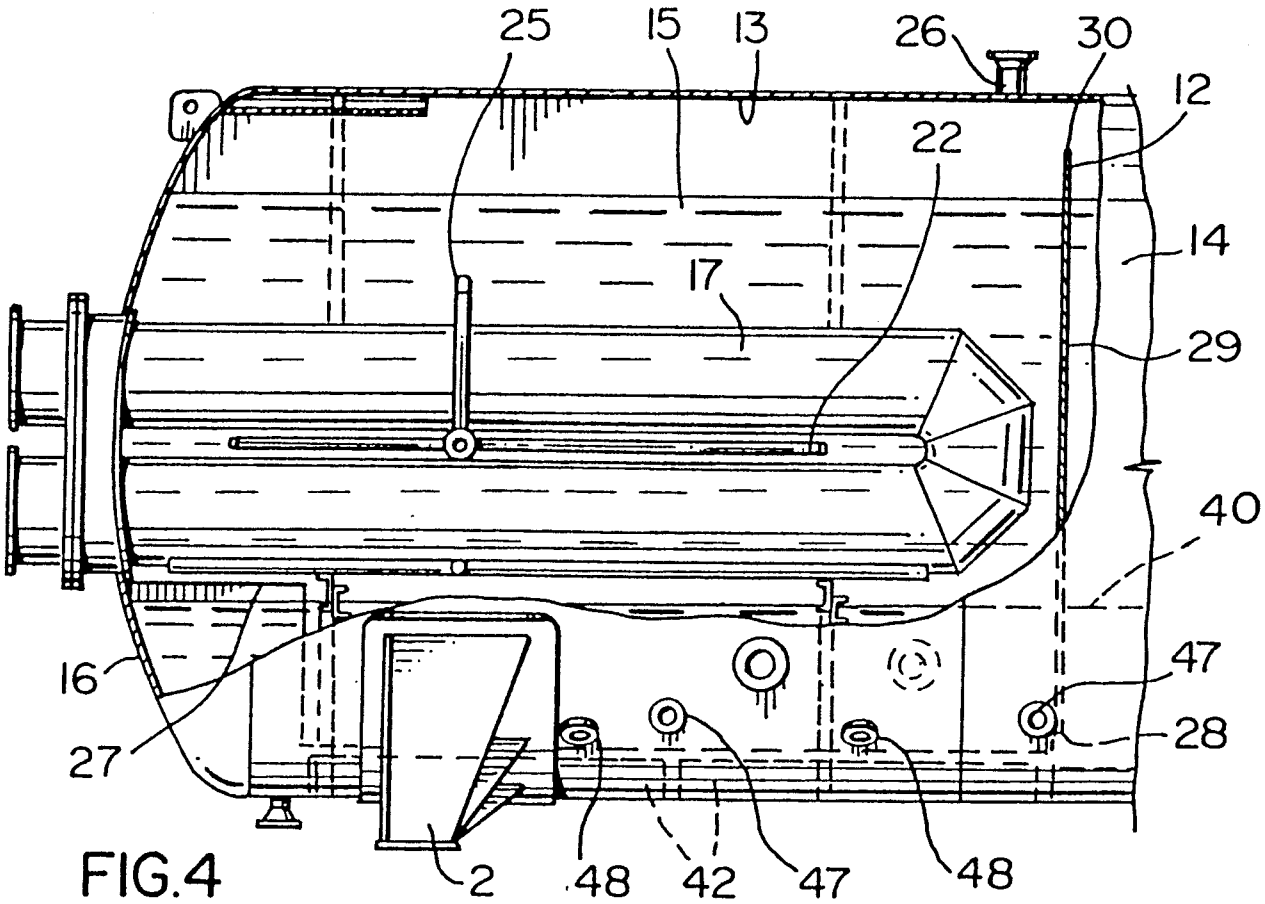
FIG. 4 is a partly sectioned elevation view of the inlet end of the apparatus of FIGS. 1 and 2.
Figure 5:
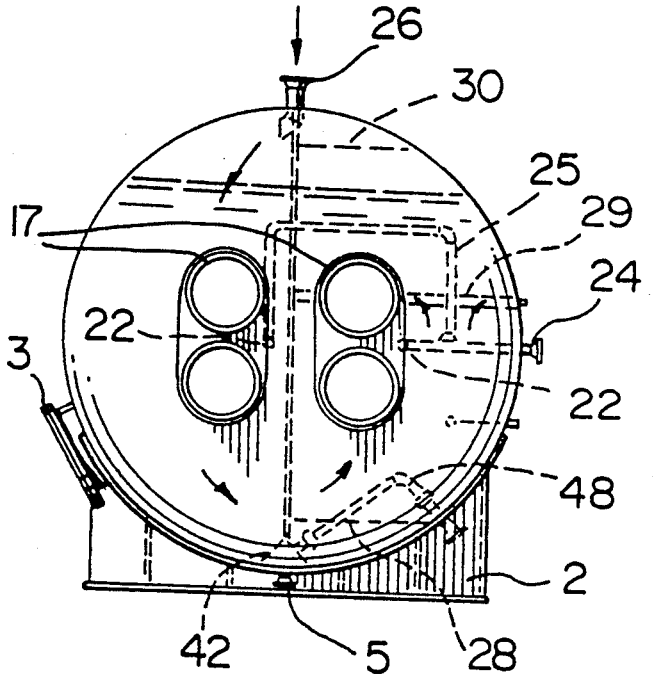
FIG. 5 is an end view of the inlet end of the apparatus of FIGS. 1 and 2.
Figure 6:
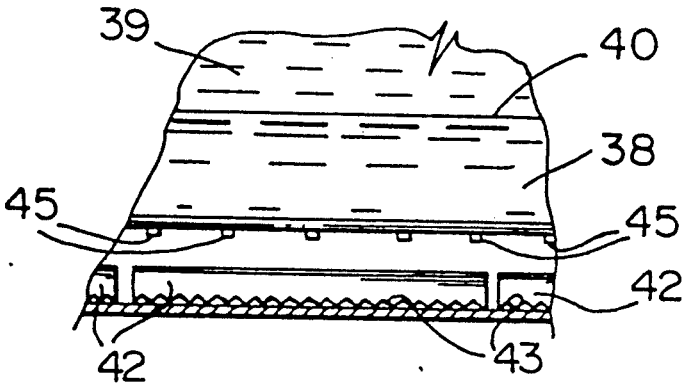
FIG. 6 is a schematic, longitudinal sectional view of a bottom, central portion of the apparatus of FIGS. 1 and 2.

Sand settling out of the crude oil in the inlet and settling chambers 13 and 14, respectively is discharged via desanders 42. Each desander 42 is an inverted pan with closed ends and an inverted V-shaped cross section. The bottom edge 43 (FIG. 6) of each side of each pan is serrated, so that sand can pass into the desander. Water jets force the sand into the desanders 42. The water jets emanate from nozzles 45 extending downwardly from longitudinally extending pipes 46 connected to inlet pipes 47. Sand is discharged from the pans through pipes 48 (FIGS. 4 and 5). A transversely extending bottom weir 49 (FIG. 2) near the discharge end of the treating section 7 is intended to keep sand in the area of the desanders 42. Water passing over the weir 49 is discharged from the casing via a header 51 and an outlet pipe 52. A water siphon drain 53 is also provided in the downstream end of the treating section 7.

Figure 2:
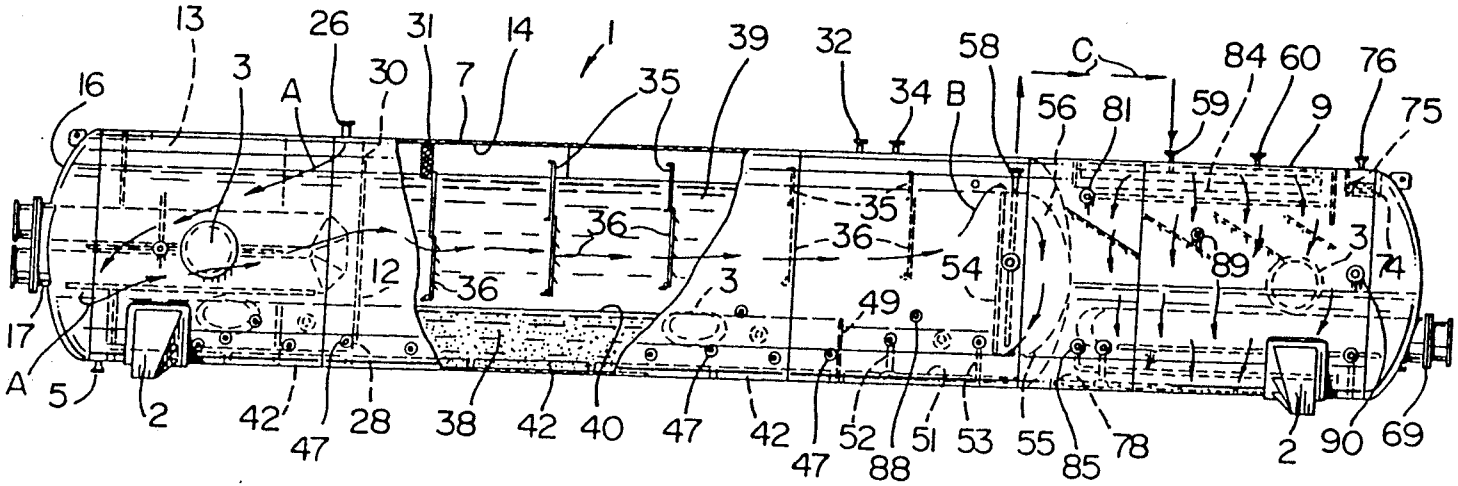
FIG. 2 is a schematic, partly sectioned side view of the apparatus of FIG. 1.
Figure 3:
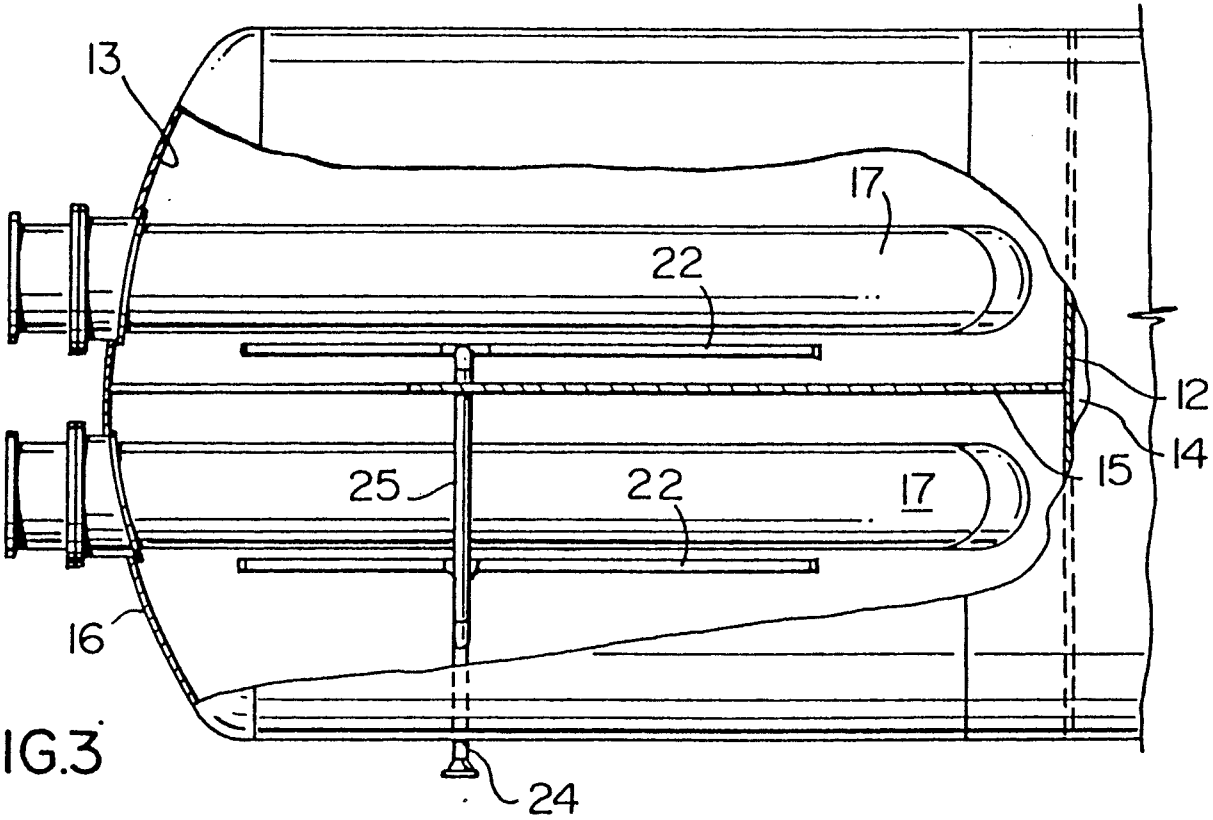
FIG. 3 is a partly sectioned plan view of the inlet and of the apparatus of FIGS. 1 and 2.

The oil on the oil layer, which still contains some sand and water, passes over one wall 54 of a trough 55 in the direction of arrows B (FIG. 2). The trough 55 is defined by the wall 54, the downstream end of the casing 1 and an inclined wall 56. Liquid is discharged from the trough 55 through a vertical pipe 58 and is fed through pipes and valves (not shown) in the direction of arrows C to the flashing section 9 of the apparatus.

Figure 7:
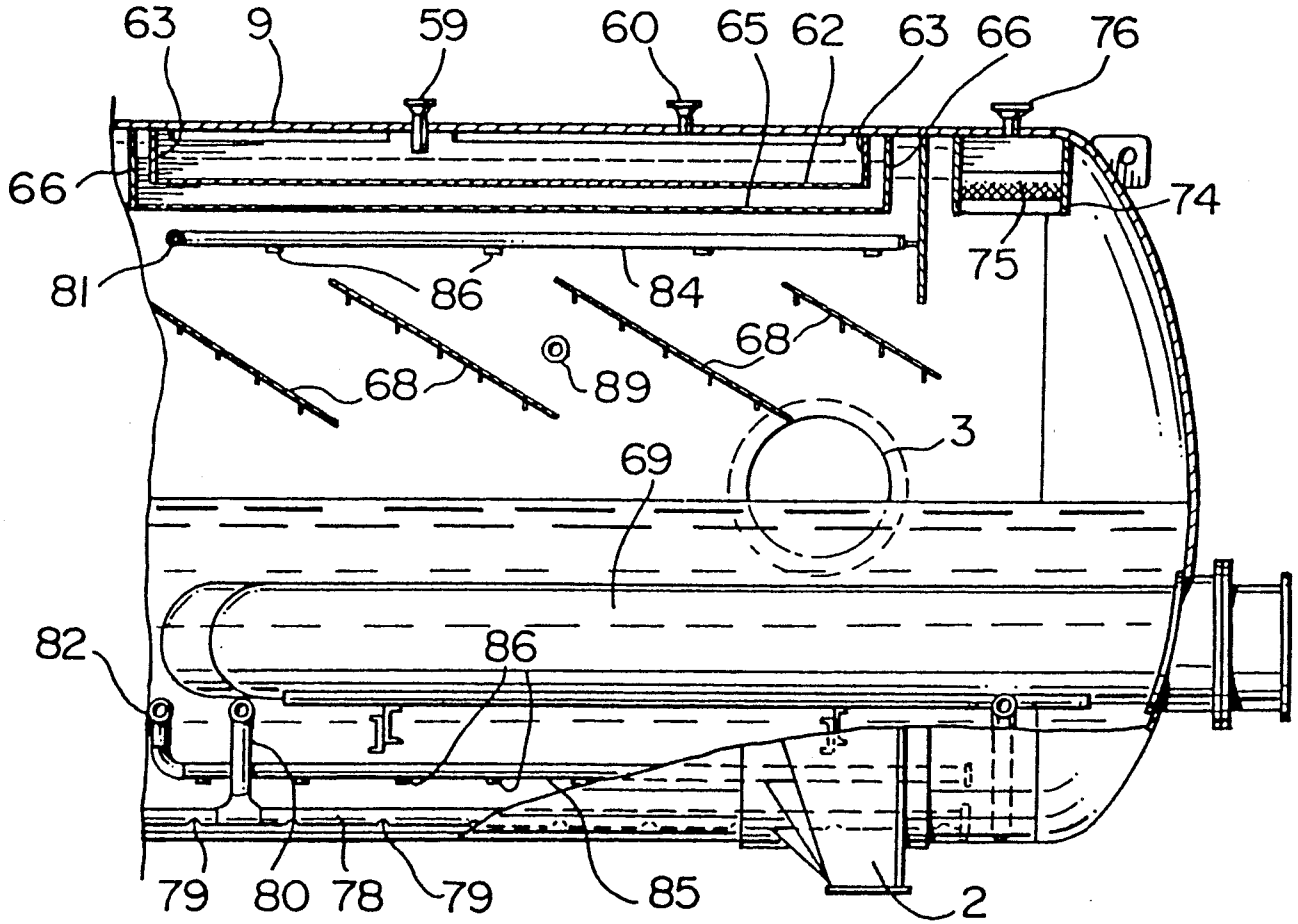
FIG. 7 is a schematic, longitudinal sectional view of the outlet end of the apparatus of FIGS. 1 and 2.

The oil enters the flashing section 9 via an inlet pipe 59 in the top of the casing 1. A pressure relief outlet 60 is also provided in the top of the casing. The oil flows into an elongated tray 62 (FIGS. 7 and 8) of semicircular cross section with closed ends 63, and overflows from the latter into a larger tray 65 of V-shaped cross section which also has closed ends 66. The oil overflows the tray 65 and drops onto inclined louvred baffles 68 for distributing the oil throughout the flashing section. The flashing section 9 contains a heater in the form of a U-shaped firetube 69 with a burner (not shown) at the outer end of one arm and a flue (not shown) at the outer end of the other arm thereof. The firetube 69 maintains the temperature of the oil in the flashing section 9 at a level at which the water can exist in vapor form only. Water vapor is discharged via a cylindrical outlet duct 74, which contains a wire mesh demister 75, and an outlet pipe 76. Dry oil is discharged through a header 78 similar to the header 51. The header 78 has openings 79 in the bottom thereof. The oil is fed from the header 78 to an outlet pipe 80. Some of the oil thus recovered is recycled and flows into the flashing section 9 through inlet pipes 81 and 82, and associated longitudinally extending headers 84 and 85, respectively. Nozzles 86 are provided in the headers 84 and 85 for discharging oil against the baffles 68 and into the area of the header 78. Thus, additional water can be removed from the oil being recycled through the header 84, and any sand remaining in the oil is caused to flow into the header 78 to prevent clogging of the flashing section 9 of the apparatus. However, oil can be recycled to adjust the oil level in the flashing section 9.

Figure 8:
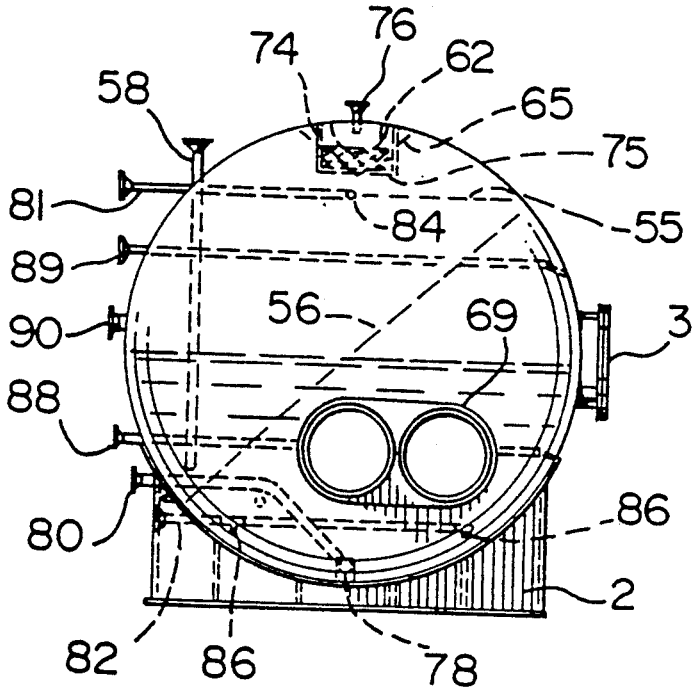
FIG. 8 is an end view of the outlet end of the apparatus of FIGS. 1 and 2.

As best shown in FIG. 8, the treating and flashing sections 7 and 9 of the casing 1 contains two transversely extending pipes 88 and 89, respectively each of which includes holes in the side thereof. The pipe 88 located in the treating section 7 is used to draw oil and water from the interface 40 between the oil and water. A float-type oil level controller (not shown) is also provided in the flashing section 9. Access to such controller is via inlet 90.

In operation, crude oil containing water, oil and solids enters the inlet end of the treating section 7 of the apparatus via the inlet pipe 26. The heating portion of the treating section 7 contains the two heater firetubes 17, which are separated by the partition 15, which permits independent temperature control and efficient heat distribution in the oil emulsion. Water and sediments sink in the treating section of the casing to form the water layer 38 beneath the oil layer 39 and the gas layer above the oil layer.

Movement of the water layer is predominantly beneath the partition 12, while oil flows through the slot 29 (FIGS. 4 and 5), and gas passes through the opening 30 above the top end of the partition 12. In the main settling or coalescing area of the treating section 7, the oil encounters the baffles 36, which are designed to cause a slight pressure drop, whereby the oil is spread across the full diameter of the casing. As mentioned above, the edges of the louvers cut the oil film around the water droplets, permitting the water to contact the baffles 36. In the settling section, most of the sand is removed from the emulsion. Water passes over the weir 49 and is discharged by the header 51 and the outlet pipe 52. Gas is discharged through outlet pipe 32. By using the appropriate valves and pressure regulators (not shown) the gas outlet can be used to control the pressure in the treating section of the apparatus. The crude oil is introduced into the casing 1 under pressure, and the back pressure created by maintaining a head of gas above the oil layer 39 in the treating section determines the operating pressure.

Oil overflowing the wall 54 enters the trough 55 and is discharged through the pipe 58 into the flashing section 9 of the apparatus. The primary function of the flashing section 9 is to remove additional water in the form of vapor from the oil. The crude oil leaving the treating section 7 of the casing 1 normally contains a small quantity of water (5–10%) for separation in the flashing section 9. Pressure is reduced prior to entering the section 9, and thus the water vaporizes because of heating and pressure reduction. For such purpose, oil entering the flashing section overflows trays 62 and 65, before impinging upon baffles 68. The oil then drops into contact with the heater tube 69, which maintains the oil bath at a temperature which permits water to exist only in vapor form. Thus, additional water in the form of vapor is caused to escape through the outlet duct 74 and the pipe 76. The flash vapor is condensed to recover water and light hydrocarbons. The upgraded crude oil is discharged through the header 78 and the outlet pipe 80. While not shown, sampling ports are provided along the length of the casing 1, i.e. in the inlet, settling and flashing portions thereof. Thus, the process can be monitored, and for example, if the upgrade crude oil contains too much water, such crude can be recycled through the flashing section until the water content of the crude oil reaches an acceptable low level.

It will be appreciated that for the sake of simplicity various elements have been omitted from the drawings and the foregoing description. For example, the rate of water removal via the header 51 is controlled by a radio wave interface type controller. The level controller in the flashing section controls movement of oil from the trough 55 to the flashing section 9.

I claim:

1. An apparatus for treating crude oil comprising casing means; first partition means separating the interior of said casing means into a treating section and a flashing section; inlet pipe means in said casing means for introducing crude oil into the treating section of said casing means; first heater means in said treating section for reducing the viscosity of the crude oil; first baffle means in said treating section for facilitating the separation of water and gas from the oil; gas outlet means in said casing means for discharging gas from said treating section; desand means in said casing means for discharging sand from said treating section; water outlet means in said casing means for discharging water from said treating section; first trough means proximate said first partition means in said treating section for receiving at least partially desanded and dewatered crude oil; oil outlet means for feeding oil from said trough means to said flashing section; oil inlet means in said flashing section of said casing means; second baffle means in said flashing section for distributing oil in said flashing section; second trough means in said flashing section of said casing means for receiving oil introduced through said oil inlet means from said first trough means and discharging the oil to said second baffle means; second heater means in said flashing section for vaporizing water remaining in said oil; vapor outlet means in said casing means for discharging water vapor from said flashing section; and treated oil outlet means in said casing means for discharging treated oil from said flashing section.

2. An apparatus according to claim 1, wherein said flashing section includes recycle means in said casing means for recycling some of the oil discharged via said treated oil outlet means into admixture with oil from said second trough means.

3. An apparatus according to claim 2, wherein said recycle means includes a pair of recycle pipes for introducing oil into the oil from said second trough means and into oil entering said treated oil outlet means.

4. An apparatus according to claim 1 including interface pipe means in the treating section of said casing means for removing oil and water from the interface therebetween.

5. An apparatus according to claim 1 including weir means in said casing means between said desand means and said water outlet means for restricting the flow of sand to said water outlet means.

* * * * *